US006279663B1

(12) United States Patent
Sundholm

(10) Patent No.: US 6,279,663 B1
(45) Date of Patent: Aug. 28, 2001

(54) NOZZLE AND FIRE FIGHTING INSTALLATION

(76) Inventor: Göran Sundholm, Ilmari Kiannon kuja 3, FIN-04310 Tuusula (FI)

( * ) Notice: Subject to any disclaimer, the term of this patent is extended or adjusted under 35 U.S.C. 154(b) by 0 days.

(21) Appl. No.: 09/445,340

(22) PCT Filed: Jun. 11, 1998

(86) PCT No.: PCT/FI98/00502

§ 371 Date: Jan. 10, 2000

§ 102(e) Date: Jan. 10, 2000

(87) PCT Pub. No.: WO98/58705

PCT Pub. Date: Dec. 30, 1998

(30) Foreign Application Priority Data

Jun. 13, 1997 (FI) ..... 972536

(51) Int. Cl.[7] ..... A62C 35/00

(52) U.S. Cl. ..... 169/16; 169/37; 169/5; 169/19; 169/20

(58) Field of Search ..... 169/5, 16, 19, 169/20, 37; 239/436, 437, 438, 443, 451, 452, 453, 456, 459, 533.1, 537, 541, 570, 583; 137/115.08, 115.11, 513.3

(56) References Cited

U.S. PATENT DOCUMENTS

| | | | | |
|---|---|---|---|---|
| 1,004,770 | * | 10/1911 | Galloway | 239/533.1 |
| 4,157,733 | * | 6/1979 | Ewers et al. | 169/24 |
| 4,991,780 | * | 2/1991 | Kannan et al. | 239/453 X |
| 5,531,275 | * | 7/1996 | Sundholm | 169/16 |
| 5,573,065 | * | 11/1996 | Sundholm | 169/37 |
| 5,639,029 | * | 6/1997 | Sundholm | 239/488 |
| 5,655,608 | | 8/1997 | Sundholm | 169/90 |

FOREIGN PATENT DOCUMENTS

| | | | | |
|---|---|---|---|---|
| 19514939 | | 10/1996 | (DE) . | |
| 1281412 | | 7/1972 | (GB) . | |
| 26677392 | | 9/1992 | (JP) . | |
| 9215370 | | 9/1992 | (WO) . | |
| WO92/20453 | * | 11/1992 | (WO) | 169/37 |
| 9531252 | | 11/1995 | (WO) . | |
| 9601666 | | 1/1996 | (WO) . | |

* cited by examiner

*Primary Examiner*—David A. Scherbel
*Assistant Examiner*—Robin O. Evans
(74) *Attorney, Agent, or Firm*—Ladas & Parry

(57) ABSTRACT

The invention relates to a nozzle, preferably for use in sprinklers and spray heads, for spraying extinguishing medium, the nozzle comprising a housing (7), an inlet end (1) and a first conduit (2) leading from the inlet end to a nozzle opening (3) to enable the spraying of the medium through the nozzle. In order that the flow in the nozzle would grow notably with an increase in pressure, the nozzle comprises a second conduit (4) for spraying the medium from the nozzle, a valve element (6) loaded by a spring (5) being arranged in the conduit so as to keep the second conduit closed when the valve element is subjected to a first pressure by said medium, and the valve element being arranged to open said second conduit when the valve element is subjected to a second pressure by said medium, and the second pressure being higher than the first pressure. The invention also relates to a fire fighting installation in which nozzles of the above type are used and in which the pressure source is arranged to increase the flow of the extinguishing medium so that the power produced by the pressure source will not drop directly proportionally to a decrease in pressure.

15 Claims, 4 Drawing Sheets

NOZZLE AND FIRE FIGHTING INSTALLATION

BACKGROUND OF INVENTION

The invention relates to a nozzle, preferably for use in sprinklers and spray heads, for spraying medium, the nozzle comprising a housing, an inlet end and a first conduit leading from the inlet end to a nozzle opening to enable the spraying of the medium through the nozzle.

The invention also relates to a fire fighting installation comprising a number of sprinklers or spray heads, including nozzles, each nozzle comprising a housing, an inlet end and a first conduit leading from the inlet end to a nozzle opening for spraying medium through the nozzle, the sprinklers or spray heads being arranged to be activated depending on the location of the fire so that only some of the sprinklers or spray heads are activated at the beginning of the extinguishing process; and the installation also comprising a pressure source and lines for supplying the extinguishing medium to the sprinklers or spray heads.

The invention also relates to a fire fighting installation comprising a number of sprinklers or spray heads, including nozzles, each nozzle comprising a housing, an inlet end and a first conduit leading from the inlet end to a nozzle opening for spraying medium through the nozzle, the sprinklers and spray heads being arranged to be activated depending on the location of the fire so that only some of the sprinklers or spray heads are activated at the beginning of the extinguishing process; and the installation also comprising a pressure source comprising a pressure accumulator, and lines for supplying the extinguishing medium to the sprinklers or spray heads.

The flow of the medium, such as liquid, outlet from the nozzle is dependent on the pressure p which discharge the medium through the nozzle.

The dependence is such that the quantity Q of flow fulfils the formula $Q=K\sqrt{p}$, where K is the resistance of the nozzle. The K value depends on the diameter d of the nozzle opening in accordance with the formula $K=0.78\ d^2$, when the opening is a so-called short opening. From the above formulae it is apparent that the flow will not increase much when the pressure rises and the K value is constant. In some applications, for example in fire fighting, a great increase in the flow is desirable when the pressure rises, as will be understood from the following.

The fire fighting systems are usually designed to cover a defined area or large space. On the land base applications the basis of design is an area of 205 $m^2$, which requires 15 sprinklers. The drive or pressure units of the fire fighting systems are designed in accordance with the area or space so that a desired pressure and flow of water are achieved for the area to be covered. In the case of a sprinkler system in which the sprinklers and/or spray heads are activated by heat either individually or in groups, the fire can usually be brought under control even with only a few of the spray heads or sprinklers necessitated by the design. The controlling of the fire means that it cannot spread. The fire can usually be brought under control with two sprinklers, whereby it is not necessary for any more sprinklers to be activated. Even when the fire is under control, however, it continues to burn and produce a notable amount of smoke and gas. The flue gases can be very toxic and even kill people; in addition, the smoke hampers the visibility and thereby hinders the firemen in their work. In situations like this, only a fraction of the fire fighting power of the drive or pressure units of the fire extinguishing systems are used, which can be shown by calculations. The power P used is directly proportional to the flow Q and pressure p and inversely proportional to the efficiency of the drive unit.

The pressure unit of the fire fighting installation is designed so that a predefined flow of water with a predefined pressure is achieved in the area to be covered. If, for example, the area requires 15 sprinklers and the flow of a sprinkler is 13 l/min at a pressure of 60 bar, the total flow of the fire fighting installation is 195 l/min when all the sprinklers have been activated. When the loss of pressure in the lines is 20 bar and the efficiency is 0.85, the power demand in the pressure unit is 30 kW. If only two sprinklers are activated, only 13% of the power is used, i.e. about 4 kW. The K value of the nozzle is here 1.7, and the efficiency is 60%.

The drawback in the previously known fire fighting installations is that only part of the power of the pressure unit is used for extinguishing the fire when only some of the nozzles of the fire fighting installation are activated. Consequently, the fire cannot often be extinguished immediately. In order that the fire could always be extinguished as quickly as possible, very expensive systems would have to be used.

BRIEF DESCRIPTION OF INVENTION

An object of the invention is to provide a nozzle in which the flow increases heavily as the pressure rises.

Another object of the invention is to provide a fairly simple fire fighting installation that enables the delivery of a large amount of extinguishing medium to the fire area at the very beginning of the extinguishing process even when only some of the spray heads and nozzles of the fire fighting installation are activated, whereby a large amount of extinguishing medium is delivered to the fire area immediately. The arrangement allows the maximum fire fighting capacity to be used from the very beginning, and so the fire can often be extinguished immediately.

In order that the full power of the drive unit of the fire fighting installation could be used, the pressure should be raised up to about 290 bar in accordance with the formula presented above, if only two conventional nozzles, i.e. nozzles whose K value is constant, are activated. The flow is then about 29 l/min per nozzle. It is not, however, economically sensible to raise the pressure so much, and even if it is raised, the flow will not increase sufficiently.

The fire fighting installation of the invention comprises sprinklers or spray heads with such a structure that the K value of the nozzles is not constant but changes with the pressure within a certain pressure range. The arrangement enables a strong flow and efficient use of the fire fighting installation at the very beginning of the extinguishing process, even though only some of the sprinklers or spray heads have been activated. As usual, the basis of design of the fire fighting installation is the controlling of the fire when all the sprinklers or spray heads necessitated by the design have been activated.

When the fire fighting installation of the invention is used, the nozzles of the spray heads are, for example, such that their K value at 120 bar is 4.4. This means an about 49 l/min flow of water per nozzle when only two spray heads are activated. The flow is thus about 2.6-fold as compared with the situation when the K value 1.7. This kind of combination of water flow and pressure means that the power of the pressure unit is about 27 kW when there are two nozzles, the losses of pressure in the lines are 20 bar, and the efficiency of a pump unit is 0.85. If all the 15 sprinklers are activated, the pressure will drop to 60 bar, and the flow will be 13 l/min per nozzle, which is needed to control the area. When the pressure drops from 120 bar, the efficiency of the pressure unit remains almost constant, unlike in the previously known fire fighting installations.

A nozzle of the invention is characterized by comprising a second conduit for spraying the medium through the nozzle, a valve element loaded by a spring being arranged in the conduit so as to keep the second conduit closed when the valve element is subjected to a first pressure by said extinguishing medium, and the valve element being arranged to open said second conduit when the valve element is subjected to a second pressure by said extinguishing medium, and the second pressure being higher than the first pressure. The preferred embodiments of the nozzle of the invention are described in attached claims 2 to 8.

The fire fighting installation of the invention is characterized in that the nozzle comprises a second conduit for spraying the extinguishing medium through the nozzle, a valve element loaded by a spring being arranged in the conduit to keep the second conduit closed when the valve element is subjected to a first pressure by said medium, and the valve element being arranged to open said second conduit when the valve element is subjected to a second pressure by said medium, and the second pressure being higher than the first pressure, and the pressure source being arranged to supply extinguishing medium first at a high pressure, and as the pressure drops in the lines when an increasingly large number of sprinklers or spray heads are activated, the pressure source being arranged to increase the flow so that the power supplied by the pressure source will not drop directly proportionally to the drop in the pressure.

When water is used as the extinguishing medium, the advantage of small droplets is that they can bind energy more efficiently than large droplets.

On account of this, a larger area can be covered by the same amount of water. The droplets grow smaller as the pressure rises. Also, the speed of the droplets grows as the pressure rises, thereby adding to the penetration of the droplets into the fire, which is particularly necessary at the beginning of the extinguishing process. On account of the above, a pressure source that can produce a high pressure is used in the fire fighting installation of the invention.

The structure of the fire fighting installation should be such that it takes account of the options offered by the nozzles. To this effect, the pressure source of the fire fighting installation comprises, in an embodiment of the invention, a motor to which is connected a pump unit that comprises at least two pumps for one and the same motor.

The pressure source preferably comprises a motor to which is connected a first pump and a second pump, a first unloading valve being arranged in a first outlet line of the pump, the unloading valve being arranged to prevent the first pump from supplying extinguishing medium to the sprinklers or spray heads, if the pressure in the outlet line exceeds a certain first pressure, but being arranged to supply extinguishing medium from the first pump to at least some of the sprinklers or spray heads, if said first pressure is not reached.

The preferred embodiments of the fire fighting installation are disclosed in attached claims 10 to 15 and 17.

The fire fighting installation of the invention comprising a pressure accumulator is characterized by:

the nozzle comprising a second conduit for spraying extinguishing medium through the nozzle, a valve element loaded by a spring being arranged in the conduit to keep the second conduit closed when the valve element is subjected to a first pressure by said medium, and the valve element being arranged to open said second conduit when the valve element is subjected to a second pressure by said medium, and the second pressure being higher than the first pressure, and the pressure source being arranged to supply extinguishing medium first at a high pressure and then at a lower pressure, and as an increasingly large number of sprinklers or spray heads are activated, the pressure source being arranged to increase the flow.

The invention is substantially based on the idea of designing and putting to use a new nozzle in which the flow changes with the pressure in such a way that it grows notably stronger when the pressure rises. When this kind of a nozzle is applied to a fire fighting installation that comprises a number of sprinklers or spray heads that are activated individually or in groups, the power of the drive unit of the fire fighting installation can be used efficiently to make the extinguishing medium flow out through the nozzle/nozzles, and the amount of flow can be rendered high.

The advantage of the nozzle according to the invention is that the flow can be greatly increased with the rising pressure.

The foremost advantage of the fire fighting installation of the invention is that it uses the power of the drive unit more efficiently than the earlier solutions when only some of the sprinklers or nozzles are activated. On account of this, the extinguishing process is very efficient from the very beginning, and this reduces the problems with smoke.

BRIEF DESCRIPTION OF FIGURES

In the following the invention will be described in greater detail by means of two preferred embodiments, with reference to the attached drawing, in which.

DETAILED DESCRIPTION OF INVENTION

Figure 1:
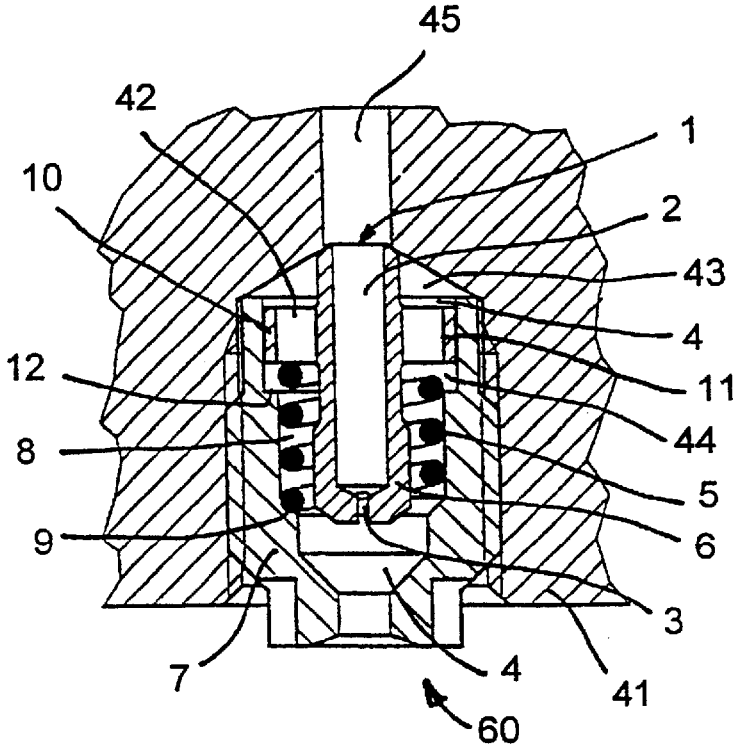
FIG. 1 shows a nozzle of the invention in a first working mode.
Figure 4:
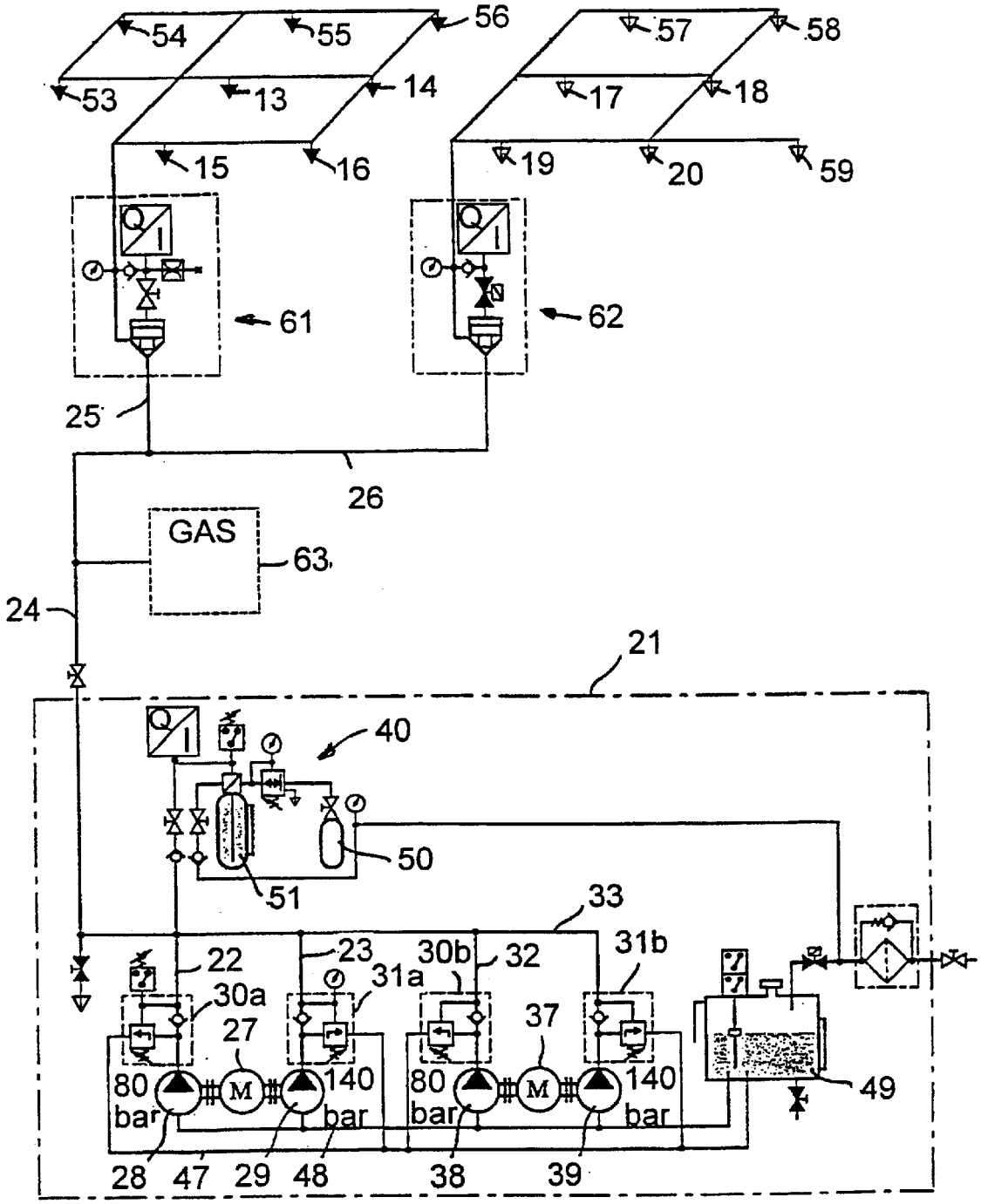
FIG. 4 shows a fire fighting installation of the invention.
Figure 5:
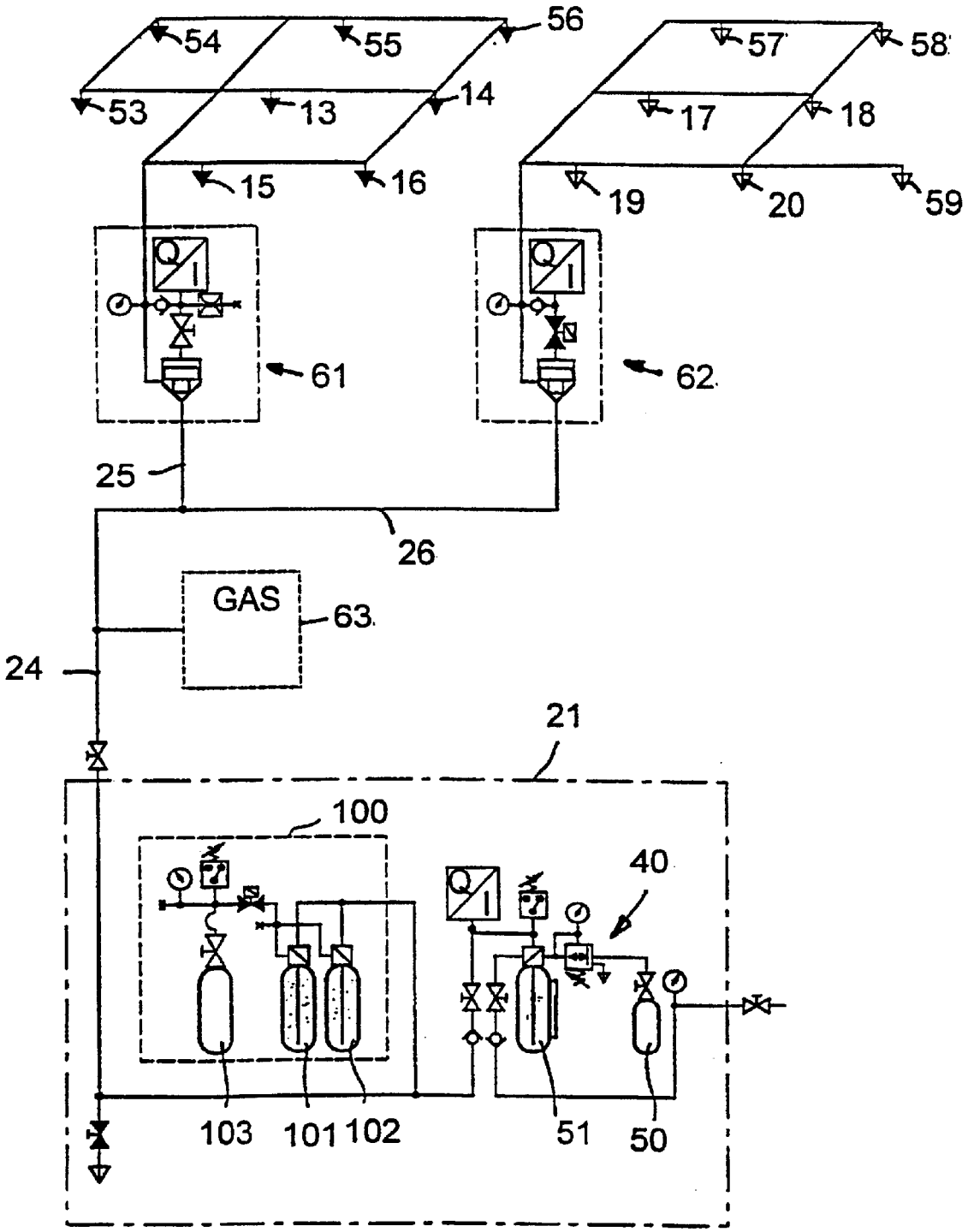
FIG. 5 shows an alternative fire fighting installation of the invention.

FIG. 1 shows a nozzle 60, suitable for use in sprinklers 13 to 16 and 53 to 56 and in spray heads 19, 20 and 57 to 59 of FIGS. 4 and 5. The position of the nozzle 60 in FIG. 1 is the one it is in when the spray head is in a standby mode.

The nozzle 60 is connected with screws to a housing 41 of the spray head and comprises a housing 7, an inlet end 1 for extinguishing medium, such as water, and a conduit 2 conveying extinguishing medium from the inlet end 1 to the nozzle opening 3. The conduit 45 of the housing 41 leads to conduit 2.

Conduit 2 is formed in a valve element 6 of the nozzle, which is a sleeve-like member. To the valve element 6 is connected a flange-like 10 member fixedly mounted on it, the member being arranged to rest against a wall 11 of a conduit 4 formed in the housing 7 of the nozzle. The flange-like member 10 comprises a conduit 42 or conduits arranged in such a way that spaces 43 and 44 above and under the flange-like member have a flow connection. A helical spring 5, which is supported from below on a shoulder 9 formed in the housing of the nozzle, loads the flange-like member 10 so that the upper end of the valve element 6 seals the mouth of conduit 45 and prevents conduit 45 from having a flow connection with conduit 4.

Figure 2:
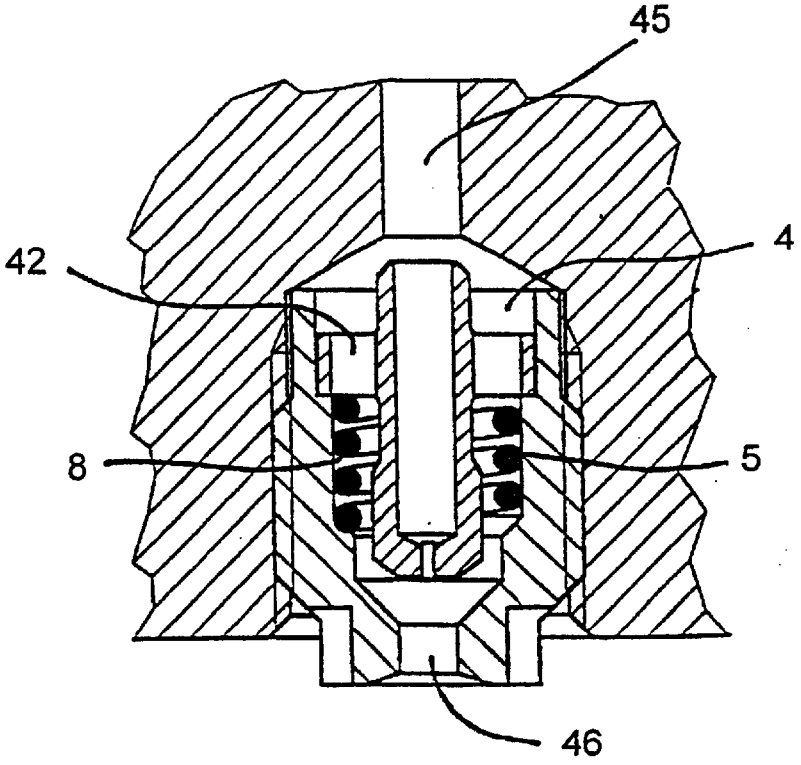
FIG. 2 shows a nozzle of FIG. 1 in a second working mode.

In FIG. 2 the nozzle of FIG. 1 is shown in the open mode. The valve element 6 is here pressed downward so that its upper end no longer seals the mouth of conduit 45 but is spaced from it, whereby conduit 45 has a flow connection with conduit 4, which leads to a nozzle opening 46. The helical spring 5 is arranged around the valve element 6 and inside the housing 7 of the nozzle in such a small space that the extinguishing medium flows on a spiral path 8 formed between the coils of the helical spring. Because of the path 8 the extinguishing medium flows at a very high rate, which is advantageous. The nozzle is moved to the position shown in FIG. 2 when there is a sufficiently high pressure in conduit 45. FIGS. 1 and 2 show that a shoulder 12 is formed in the housing 41 of the nozzle, and the shoulder prevents the valve element 6 from moving downward so much that the valve element would block conduit 4.

In the position shown in FIG. 2, the extinguishing medium can flow along both conduit 2 and conduit 4 to the nozzle opening 46. The jet obtained from the nozzle opening 46 is also very strong and fast in this position because conduit 4 surrounds conduit 2 centrally. When an aqueous fog jet is used, the droplets are small in size. Because of its high velocity, the aqueous fog penetrates well into the seat of fire.

Figure 3:
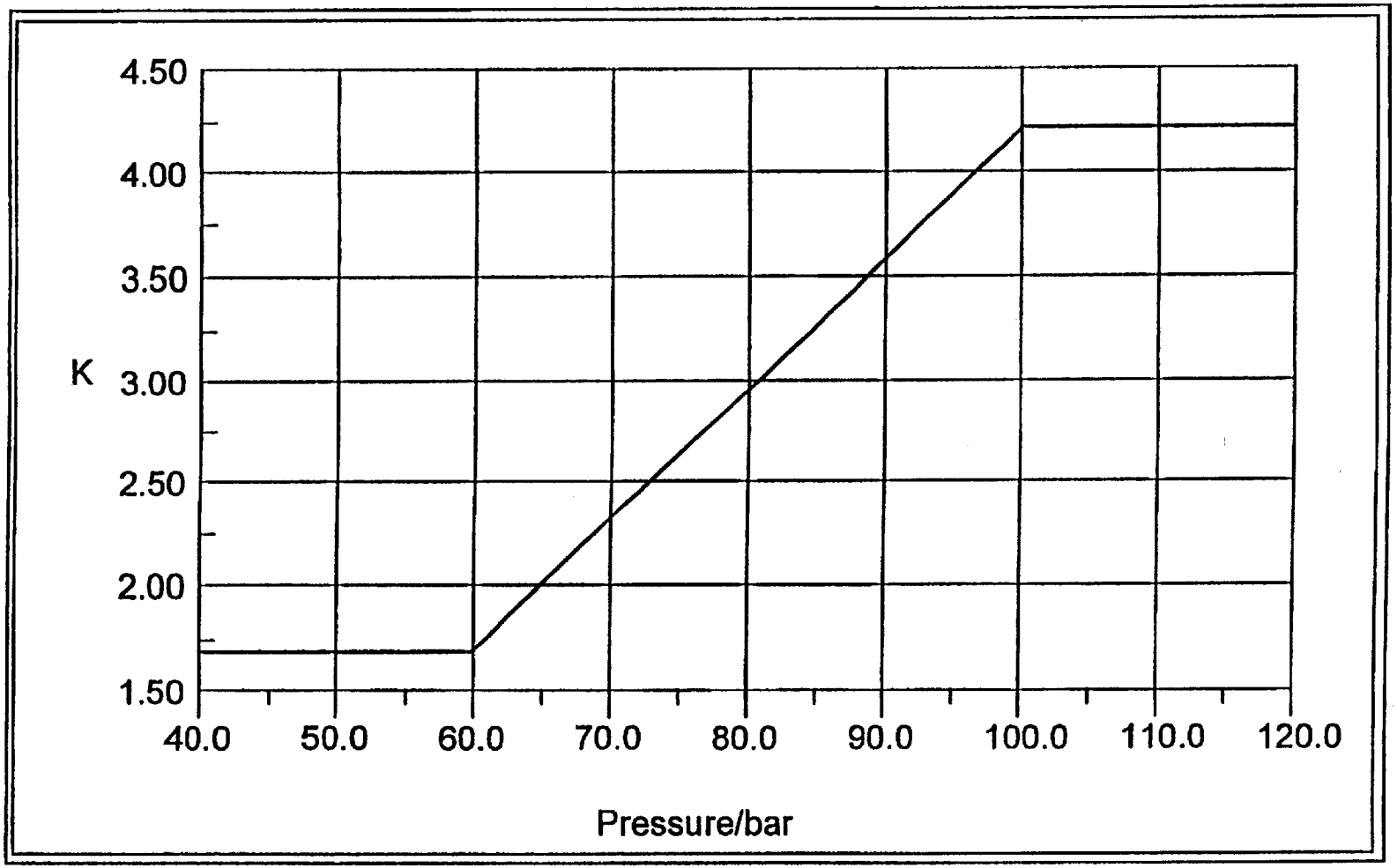
FIG. 3 illustrates the change of the K value of the nozzle shown in FIG. 1 as a function of pressure.

The K value of the nozzle of FIG. 1 changes as a function of the pressure prevailing in conduit 45 in accordance with FIG. 3. FIG. 3 shows that the K value of the nozzle is essentially constant within the pressure range 40 to 60 bar and is about 1.7. This is the situation when the valve element 6 of the nozzle is in the position shown in FIG. 1. When the pressure is raised, the valve element is pressed downward. Within the pressure range 60 to 100 bar, the K value of the nozzle grows strongly with the pressure, cf. FIG. 3. Said pressure range illustrates a situation in which the valve element 6 moves from the position shown in FIG. 1 to the position shown in FIG. 2. In FIG. 2 the valve element 6 is in the lowermost position, which it moves to when the pressure is at least 100 bar. In this position the K value of the nozzle is 4.4. If the pressure is raised further, the K value hardly changes any more, cf. FIG. 3.

FIG. 4 shows a fire fighting installation of the invention, in which the nozzles according to FIG. 1 are used.

The fire fighting installation comprises two extinguishing zones: one has eight sprinklers 13 to 16, 53 to 56 or spray heads with releasing means, for example, in the form of liquid ampoules, and the other has four spray heads 17 to 20, 57 to 59. Each sprinkler and spray head comprises a nozzle according to FIG. 1.

The drive unit or pressure source of the fire fighting installation is generally indicated by reference number 21. The pressure source comprises a water tank 49 and two motor-pump units connected in parallel, each unit comprising a 15-kW motor 27 and 37, to which are connected two pumps 28, 29 and, respectively, 38, 39. The maximum pressure produced by pumps 29 and 39 is, for example, 160 bar; the maximum pressure produced by pumps 28 and 38 is, for example, 100 bar. The maximum pressure of the pumps of the fire fighting installation according to the invention is preferably within the range 30 to 200 bar. The inlet ends of the pumps 28, 29, 38, 39 are connected to the water tank 49 with conduit 48. Lines 22 to 26, 32, 33 lead from the pumps 28, 29, 38, 39 to the sprinklers 13 to 16, 53 to 56 and spray heads 17 to 20, 57 to 59.

To pumps 28 and 38 are connected unloading valves 30*a*, 30*b*, which prevent the flow of the extinguishing medium from the pumps to the main line 24, if the pressure exceeds 80 bar. When the motors 27, 37 are running and the pressure is above 80 bar, pumps 28, 38 circulate the extinguishing medium, which is preferably water, along conduits 47, 48 from the tank 49 back to the tank. Pumps 28, 38 are here operated by 'idle circulation'. Correspondingly, pump 38 circulates the extinguishing medium along lines 47, 48 from the tank 49 back to the tank.

Reference numbers 61 and 62 indicate zone valves. Valve 61 is open in the figure, and valve 62 is closed. Valve 61 is open in the standby mode. The structure of the valves is, for example, as shown in the international patent publication WO 94/14501. If a sprinkler or spray head 13 to 16, 53 to 56 goes off, a sensor connected to valve 61 starts the motors 27, 37 of the pump unit 21 to pump the extinguishing medium into line 24.

To pumps 29 and 39 are connected unloading valves 31*a*, 31*b*, which enable the supply of the extinguishing medium into the main line 24 always when the pressure is below 140 bar. The unloading valves 31*a*, 31*b* can be called safety valves. Because of the unloading valves 31*a*, 31*b*, pumps 29, 39 do not supply the extinguishing medium to the main line 24, if none of the sprinklers or spray heads has been activated or if the zone valves 61, 62 of the system are closed.

The fire fighting installation is designed so that the activation of two sprinklers, for example sprinklers 13 and 14, does not suffice to drop the pressure below 80 bar, but it produces a pressure of 140 bar. In a situation like this, i.e. when the pressure is very high, only pumps 29 and 39 supply water to the main line 24. If other sprinklers and/or spray heads are activated in addition to sprinklers 13 and 14, the pressure will drop. When a sufficiently large number of sprinklers and spray heads has been activated, the pressure will drop to slightly below 80 bar. In such a situation, the unloading valve 30 enables the flow of the extinguishing medium to the main line 24, whereby all pumps 28, 29, 38, 39 supply water to the main line 24 with said pressure of slightly below 80 bar.

Reference number 40 indicates a pressure accumulator with which a standby pressure of about 5 to 20 bar is maintained in lines 24 to 26. The standby pressure prevents the members of the installation from being subjected to a great pressure shock when the motors 27, 37 are started. The operation of the sprinklers is very rapid, since there is continuously water in lines 24 to 26. This also prevents a great pressure shock when the sprinklers are activated. Reference number 50 indicates a source of gas, for example, a nitrogen gas bottle, and reference number 51 indicates a water tank.

The operation of the fire fighting installation of the invention will be described in the following.

The raise in temperature caused by the fire activates for example sprinklers 13 and 14. Subsequently, zone valve 61 supplies a signal that starts the motors 27, 37, and pumps 29 and 39 start to supply water to sprinklers 13, 14 at a high pressure of about 140 bar. When the power of each motor 27, 37 is 15 kW, pumps 29, 39 each supply 48.7 l/min water, i.e. about 97 l/min in all. If sprinklers 15, 16, 53 and 56 and spray heads 17 to 20, 57 to 59 are also activated, the pressure will drop to below 80 bar. The spray heads 17 to 20, 57 to 59 can be activated by opening valve 62, for example, manually or by means of a smoke detector. When the pressure drops to below 80 bar, pumps 28 and 38 also start to supply water to the main line 24 so that the amount of water supplied to the main line is about 195 l/min. This fulfils the design principle, according to which each spray head delivers a 13 l/min flow.

Gas, such as nitrogen gas, can be added to the water flow, for example, in accordance with WO 95/28204 to improve the efficiency of the extinguishing process at the final stage. This is indicated by block 63 shown in FIG. 4.

FIG. 5 illustrates a second embodiment of the invention. In the figure, like reference numbers indicate like members as in FIG. 4. The embodiment differs from the embodiment of FIG. 4 in that the pressure source is a pressure accumulator. The motor-pump unit with the unloading valves and water tanks is thus replaced with a pressure accumulator 100, which comprises two water tanks 101, 102, to which is connected a gas tank 103 producing a high pressure of for example 200 bar. The pressure of the pressure accumulator 100 is high at the beginning of the extinguishing process, and it is reduced as the water tanks 101, 102 empty. The pressure accumulator can thus be designed to automatically supply the desired flow to the main line 24. Another advantage of the pressure accumulator 100 is that it is simple in structure and does not require electricity or other external energy to operate. The number of the water tanks 101, 102 can naturally vary from one to a plural number of tanks, and there may be several pressure accumulators. The initial pressure of the pressure accumulator, i.e. the pressure at the beginning of the extinguishing process, can be, for example, within the range 30 to 300 bar, typically 100 to 250 bar.

It will be obvious to those skilled in the art that the invention can vary in its details in many ways within the scope of the attached claims. For example, the unloading valves can be adjusted to different pressures from what is stated above. The essential point is that the unloading valves of the pumps connected to the same motor are adjusted to different pressures, so that the pumps can be activated step-by-step, if necessary. The number of the motors and the pumps to be activated step-by-step can vary. The fire fighting installation can comprise several unloading valves adjusted to different pressures. If, for example, there are unloading valves adjusted to four different pressures and connected to corresponding pumps, a four-step operation is achieved: the pump to which is connected the unloading valve adjusted to the highest pressure supplies to the main line 24 first, and as the pressure then drops, the pump to which is connected the unloading valve adjusted to the second highest pressure then starts to supply, etc. Instead of the motor-pump-unloading-valve arrangement it is possible to use a pump with a constant power: the flow in the pump can be adjusted by adjusting the stroke length of the pistons so that the pump maintains a constant power. The adjustment is effected, for example, by using an oblique plate that is controlled by the pressure and acts against a spring; i.e. when the pressure rises, the flow is adjusted to be lower, and vice versa, and the use of power is maintained at a constant level, and the maximum water flow—in respect of the pressure—is produced. In the above example, this kind of pump would produce a 97 l/min water flow, for example, at a pressure of 140 bar, when two sprinklers have been activated, and the water flow would increase steplessly with a decrease in pressure, i.e. when more sprinklers are activated.

The nozzle of the invention is also applicable to a common low-pressure sprinkler, in connection with which a centrifugal pump and/or a pressure vessel is used. The centrifugal pump then has a higher pressure and a stronger flow than where a sprinkler with a constant K value is concerned. When the pressure vessel is used, the flow is strong when the pressure is high, and normal when the pressure is low. The spring need not necessarily be a helical spring, but it can be a member of elastomer, which yields when it is loaded by the valve element so that the valve element moves and opens the second conduit 4. Such a valve element, however, does not make the extinguishing medium flow along a spiral path.

The fire fighting installation according to the invention can comprise several sprinklers and spray heads, arranged in one or more extinguishing zones. The sprinklers and spray heads can also be arranged to be activated on account of smoke rather than high temperature. Unlike in FIGS. 4 and 5, the fire fighting installation can also comprise only sprinklers or only spray heads.

What is claimed is:

1. A nozzle for spraying extinguishing media from a sprinkler or spray head, the nozzle (60) comprising:

a housing (7);

an inlet end (1) in the housing for receiving extinguishing medium;

a first conduit (2) inside the housing leading from the inlet end for spraying the extinguishing medium;

a second conduit (4) inside the housing and communicating with the inlet end for spraying the extinguishing medium; and a valve element (6) inside the housing and loaded by a helical spring (5) so as to keep the second conduit closed when the valve element is subjected to a first pressure by the extinguishing medium, and to open the second conduit when the valve element is subjected to a second pressure by the extinguishing medium, the second pressure being higher than the first pressure, wherein the first conduit is open when the valve element is subjected to the first pressure, wherein the valve element is displaceable in relation to the housing for the opening and closing, wherein the first conduit and the second conduit lead to a common nozzle outlet (46) for the sprayings, wherein the first conduit is inside the valve element, and wherein the helical spring is spaced around the valve element and positioned inside the second conduit so that coils of the helical spring define in the second conduit a spiral path (8) for the extinguishing medium.

2. A nozzle according to claim 1, characterized in that the helical spring (5) is arranged to rest at one end against a shoulder (9) formed in the housing (7), and to rest at the other end against a flange-like member (10) formed in the valve element (6).

3. A nozzle according to claim 2, characterized in that the flange-like member (10) is arranged to rest slidably against a wall (11) formed in the housing (7).

4. A nozzle according to claim 2, characterized in that the housing (7) comprises a shoulder (12) for restricting the movement of the flange-like member (10) and the valve element (6) in such a way that the coils of the helical spring (8) define said spiral path (8) between them, although said second pressure subjects the valve element (6) to a force that exceeds the counterforce exerted by the helical spring when the helical spring is compressed.

5. A nozzle according to claim 1, characterized in that the second conduit (4) surrounds the first conduit (2) centrally.

6. A fire fighting installation comprising a plural number of sprinklers or spray heads 913 to 20, 53 to 56; 17 to 20, 57 to 59), including nozzles (60), each nozzle comprising a housing (7), an inlet end (1) and a first conduit (20 leading from the inlet end to a nozzle opening (3) for spraying extinguishing medium from the nozzle said nozzle also comprising a second conduit (4) formed in the housing (7) of the nozzle for spraying extinguishing medium from the nozzle, and a valve element (6) loaded by a helical spring (5) being arranged inside the housing so as to keep the second conduit closed when the valve element is subjected to a first pressure by said medium, and the valve element being arranged to open said second conduit when the valve element is subjected to a second pressure by said medium, the second pressure being higher than the first pressure, wherein the first conduit (2) is arranged to be open when the valve element (6) is subjected to said first pressure, the valve element is positioned in the housing (7) of the nozzle displaceably in relation to the housing of the nozzle, and the first conduit (2) and the second conduit (4) are adapted to lead medium to a common nozzle outlet (46), characterized in that the first conduit (2) is arranged inside the valve element (6), the helical spring (5) is arranged around the valve element (6) with a small spacing and is positioned inside the second conduit (4) so that the coils of the helical spring define a spiral path (8) for the extinguishing medium, the sprinklers or spray heads are arranged t be activated depending on the location of the fire so that only some (e. g. 13, 14) of the sprinklers or spray heads are activated at the beginning of the extinguishing process, and the installation comprises a pressure source (100) comprising a pressure accumulator and lines (22 to 26), including main lines (24), for supplying extinguishing medium to the sprinklers or spray heads, and the pressure source (100) is arranged to supply extinguishing medium first at a high pressure, and then at a lower pressure, and when an increasingly large number of sprinklers or sparay heads are activated, the pressure source is arranged to increase the flow.

7. A fire fighting installation according to claim 6, characterized in that the pressure source comprises gas addition means (63), which are arranged to add gas to the extinguishing medium when the pressure of the extinguishing medium drops below a certain value.

8. A fire fighting installation comprising a plural number of sprinklers or spray heads (13 to 20, 53 to 56; 17 to 20, 57 to 59), including nozzles (60), each nozzle comprising a housing (7), an inlet and (1) and a first conduit (2) leading from the inlet end to a nozzle opening (3) for spraying extinguishing medium from the nozzle, said nozzle also comprising a second conduit (4) formed in the housing (7) of the nozzle, for spraying extinguishing medium from the nozzle, and a valve element (6) loaded by a helical spring (5) being arranged inside the housing so as to keep the second conduit closed when the valve element is subjected to a first pressure by said medium, and the valve element being arranged to open said second conduit when the valve element is subjected to a second pressure by said medium, the second pressure being higher than the first pressure, wherein the first conduit (2) is arranged to be open when the valve element (6) is subjected to said first pressure, the valve element is positioned in the housing (7) of the nozzle displaceably in relation to the housing of the nozzle, and the first conduit (2) and the second conduit (4) are adapted to lead medium to a common nozzle outlet (46), characterized in that:

the first conduit (2) is arranged inside the valve element (6), the helical spring (5) is arranged around the valve element (6) with a small spacing and is positioned inside the second conduit (4) so that the coils of the helical spring define a spiral path (8) for the extinguishing medium, the sprinklers or spray heads are arranged to be activated depending on the location of the fire so that only some (e.g. 13, 14) of the sprinklers or spray heads are activated at the beginning of the extinguishing process, and the installation comprises a pressure source (21) and lines (22 to 26), including main lines (24), for supplying extinguishing medium to the sprinklers or spray heads, and the pressure source (21) is arranged to supply extinguishing medium first at a high pressure, and as the pressure drops in the large number of sprinklers or spray heads are activated, the pressure source is arranged to increase the flow so that the power supplied by the pressure source will not drop directly proportionally to the drop in the pressure.

9. A fire fighting installation according to claim 8, characterized in that the pressure source comprises gas addition means (63), which are arranged to add gas to the extinguishing medium when the pressure of the extinguishing medium drops below a certain value.

10. A fire fighting installation according to claim 8, characterized in that the pressure source comprises a motor (27), which is arranged to drive a pump unit (28, 29) that comprises at least two pumps.

11. A fire fighting installation according to claim 10, characterized in that the pump unit comprises a first pump (28) and a second pump (29), a first unloading valve (30*a*) being connected to the outlet line (22) of said first pump, and the unloading valve being arranged to prevent the first pump from supplying the extinguishing medium to the sprinklers or spray heads (13 to 16, 53 to 56; 17 to 20, 57 to 59), if the pressure in the main line (24) exceeds a certain first pressure, but said unloading valve (30*a*) being arranged to supply extinguishing medium from the first pump to at least some of the sprinklers or spray heads, if said first pressure is not reached.

12. A fire fighting installation according to claim 11, characterized in that the pumps (28 and 29) are arranged to supply extinguishing medium to at least some of the sprinklers or spray heads, if the pressure in the main line (24) is lower than said first pressure.

13. A fire fighting installation according to claim 12, characterized in that to the outlet conduit (23) of the second pump (29) is connected an unloading valve (31*a*), which in the standby mode of the fire fighting installation is arranged to prevent the second pump from supplying extinguishing medium to the sprinklers or spray heads (13 to 16, 53 to 56; 17 to 20, 57 to 59), if the pressure in the main line (24) exceeds the second pressure, which is higher than said first pressure, but the unloading valve (31*a*) being arranged to supply extinguishing medium to the main line (24) if at least one sprinkler or spray head (13 to 16, 53 to 56; 17 to 20, 57 to 59) goes off.

14. A fire fighting installation according to claim 13, characterized in that the fire fighting installation also comprises a second motor (37), which is arranged to drive a second pump unit (38, 39), which comprises a third pump (38) and a fourth pump (39), an unloading valve **(30*b*) being connected to the outlet line of the third pump (38), and the unloading valve in the standby mode of the fire fighting installation being arranged to prevent the third pump from supplying extinguishing medium to the sprinklers or spray heads (13 to 16, 53 to 56; 17 to 20, 57 to 59), if the pressure in the main line (24) exceeds a certain second pressure, which is higher than said first pressure, but the unloading valve (31 b) being arranged to supply extinguishing medium to the main line (24) if at least one sprinkler or spray head (13 to 16, 53 to 56; 17 to 20, 57 to 59) goes off, and that the outlet lines (32, 33) of the third and the fourth pump are connected in parallel to the outlet lines (22 and 23, respectively) of the first pump (28) and the second pump (29)**.

15. A fire fighting installation according claim 1, characterized by comprising a pressure accumulator (40), which is connected to the main line (24) to maintain a standby pressure in the lines (24 to 26) of the fire fighting installation.

* * * * *